US010888883B2

(12) United States Patent
Bartels et al.

(10) Patent No.: US 10,888,883 B2
(45) Date of Patent: Jan. 12, 2021

(54) NOZZLE ARRANGEMENT

(71) Applicant: SOFTHALE NV, Diepenbeek (BE)

(72) Inventors: Frank Bartels, Hattingen (DE); Juergen Rawert, Cologne (DE)

(73) Assignee: SOFTHALE NV, Diepenbeek (BE)

( * ) Notice: Subject to any disclaimer, the term of this patent is extended or adjusted under 35 U.S.C. 154(b) by 0 days.

(21) Appl. No.: 14/392,017

(22) PCT Filed: Jul. 24, 2013

(86) PCT No.: PCT/DE2013/000406
§ 371 (c)(1),
(2) Date: Jan. 28, 2015

(87) PCT Pub. No.: WO2014/019563
PCT Pub. Date: Feb. 6, 2014

(65) Prior Publication Data

US 2015/0136876 A1 May 21, 2015

(30) Foreign Application Priority Data

Jul. 30, 2012 (DE) ..... 10 2012 014 965

(51) Int. Cl.
*B05B 1/26* (2006.01)
*B05B 7/08* (2006.01)
(Continued)

(52) U.S. Cl.
CPC ..... *B05B 1/26* (2013.01); *B05B 1/083* (2013.01); *B05B 7/0892* (2013.01); *B05B 15/525* (2018.02)

(58) Field of Classification Search
CPC ... B05B 1/083; B05B 15/0241; B05B 7/0892; B05B 1/26; B05B 15/525
(Continued)

(56) References Cited

U.S. PATENT DOCUMENTS 2,823,954 A * 2/1958 Olson ..... B05B 1/14 239/462
2,921,742 A * 1/1960 Johnsyn, Jr. ..... F23D 11/28 239/125
(Continued)

FOREIGN PATENT DOCUMENTS

CN 2923046 Y 7/2007
DE 102006058756 A1 1/2008
(Continued)

*Primary Examiner* — Arthur O. Hall
*Assistant Examiner* — Steven M Cernoch
(74) *Attorney, Agent, or Firm* — Hoxie & Associates LLC

(57) ABSTRACT

The invention relates to a nozzle arrangement for atomizing a fluid flow, which is supplied under pressure, into fine particles, which has: a conical element with an upper surface, a lower surface and an outer surface which is adjacent to the upper and the lower surface, wherein the outer surface has a multiplicity of grooves which are formed therein and extend between the lower surface and the upper surface; and a counter element which is provided with a recess and is designed to receive the conical element and which has an inner surface such that the grooves are at least partially covered by the inner surface in order to form a multiplicity of channels; wherein the channels define outputs in order to let out a respective fluid jet which strikes against at least one other fluid jet in a region spaced apart from the upper surface of the conical element in order thus to atomize the fluid flow, and wherein the conical element is movable along the axis in order to increase or to reduce the effective cross section of the nozzle arrangement.

15 Claims, 5 Drawing Sheets

(51) Int. Cl.
*B05B 1/08* (2006.01)
*B05B 15/525* (2018.01)

(58) Field of Classification Search
USPC .... 239/418, 544, 552, 553, 553.3, 568, 590, 239/590.3, 590.5, 596, 598, 601, 554, 239/555, 493
See application file for complete search history.

(56) References Cited

U.S. PATENT DOCUMENTS 3,462,085 A * 8/1969 Nugarus ..... B05B 1/06 239/515
3,568,933 A 3/1971 Macguire-Cooper
3,669,419 A 6/1972 Petersen et al.
3,793,690 A * 2/1974 Wayne ..... B05B 1/14 239/590
4,258,885 A * 3/1981 Legeza ..... B05B 1/042 239/599
4,588,131 A * 5/1986 Yamamoto ..... B05B 7/0062 239/428.5
5,472,143 A 12/1995 Bartels et al.
5,547,094 A 8/1996 Bartels et al.
5,911,851 A 6/1999 Bartels et al.
6,007,676 A 12/1999 Bartels et al.
6,503,362 B1 1/2003 Bartels et al.
6,652,624 B2 11/2003 Ku et al.
7,152,808 B2 12/2006 Jenkins
7,246,615 B2 7/2007 Bartels et al.
7,959,088 B2 6/2011 Bolus et al.
8,689,985 B2 4/2014 Bates, III et al.
2003/0066421 A1 4/2003 Ku et al.
2010/0038307 A1 2/2010 Bates, III et al.

FOREIGN PATENT DOCUMENTS

EP 1286871 B1 9/2004
EP 1940531 B1 7/2013
EP 2153905 B1 10/2013
JP 2001137747 A 5/2001
JP 2001286790 A 10/2001
JP 2003193068 A 7/2003
RU 54825 U1 7/2006
WO WO1994006567 A1 3/1994
WO WO2009090084 A1 7/2009

* cited by examiner

NOZZLE ARRANGEMENT

BACKGROUND OF THE INVENTION

1. Field of the Invention

The present invention relates to a nozzle arrangement for atomizing a fluid flow, which is supplied under pressure, into fine droplets which are suitable, for example, for administering a drug by inhalation, and for supplying fragrances and the like.

2. Description of the Prior Art

As an example U.S. Pat. No. 6,503,362 B1 describes, for example, a nozzle arrangement for use in the atomizing and production of spray mists from a fluid. The nozzle arrangement comprises two elements, each with generally plane surfaces, which are connected to one another. A first set of channels is formed in the generally plane surface of a first of the elements in order, in interaction with the generally plane surface of the second of the elements, to form a multiplicity of nozzle outlet passages which are designed to let out a multiplicity of fluid jets which strike against one another in order thus to atomize a fluid flow. The arrangement operates in such a manner that use is made of microjets which are produced by a spring-loaded high pressure source and normally two small passages with a size of approximately 5 μm×5 μm. These passages are produced in a flat silicon plate, wherein silicon etching technologies are used, and are covered by a glass plate which is fastened by glass fusion technologies. The two jets leave the passage at a very high velocity and strike against each other before the nozzle. As a result, the jet is converted into a fine spray mist, with a very precise diameter distribution of approximately 4-6 μm. The kinetic energy is converted into surface energy of the liquid. The properties of the spray mist can be substantially changed by the velocity, impact point and impact angle being modified. A filter functionality can be installed by certain column structures being added. The depth of the entire structure within the microstructured substrate is therefore constant. The passages are designed in such a manner that they receive a fluid flow which is supplied at a pressure of at least 50 bar. However, the nozzle is expensive to produce and cannot be modified in a simple manner in order to meet requirements in the case of applications which differ from medical use.

DE 10 2006 058 756 A1 discloses a nozzle arrangement with an insert which has an upper surface, a lower surface and an outer surface which is adjacent to the upper and the lower surface, wherein the outer surface has a multiplicity of grooves with a diameter of 1 μm-2 mm, which are formed therein. The insert is accommodated in a form-fitting or frictional manner in a recess which is formed in a nozzle body. The nozzle body covers the grooves on the outer surface of the insert.

Furthermore, U.S. Pat. No. 3,568,933 shows a nozzle arrangement which consists of a nozzle head which has channels in an inner surface of a bore which extends through said nozzle head. The nozzle opening can be closed by a stopper which has a front conical section which is fitted into the bore such that the conical section bears against the sides of the channel in order to close the bore and to form a pair of converging, jet-forming passages.

The spray nozzle which is disclosed in U.S. Pat. No. 3,669,419 has a nozzle element which is in the manner of a truncated cone and has passages which are closed by a corresponding nozzle body region. A central outlet opening, through which atomized oil droplets can leave the nozzle, is formed.

EP 1 286 871 B1 relates to spray nozzles for vehicle windscreen washer systems. The nozzle has at least two openings, wherein each is arranged in such a manner that fluid jets leave each opening in the form of a fluid column and are directed onto the fluid column leaving the other opening. The openings can be offset from each other such that only part of the cross-sectional area of the columns of fluid intersect.

EP 1 940 531 B1 discloses an apparatus_for mixing and subsequently atomizing liquids which are fed into nozzle channels of a frustoconical insert.

Spray nozzles, in particular those with small channel diameters of only a few μm, are susceptible to blockages which can be difficult to prevent, but which have to be removed without damaging the nozzle. A related problem occurs for liquids of relatively high viscosity.

SUMMARY OF THE INVENTION

It is therefore an object of the invention to provide a nozzle arrangement in which the production costs can be lowered, which is easy to clean and is simple to modify, for example for atomizing fluids of different viscosity or for adaptation to different desired properties in the intended application.

According to the invention, a nozzle arrangement for atomizing a fluid flow, which is supplied under pressure, into fine droplets is provided, which has a conical element with an upper surface, a lower surface, an outer surface which is adjacent to the upper and the lower surface, and defines an axis, wherein the outer surface, which extends between the upper surface and the lower surface, has a multiplicity of grooves formed therein, and a counter element which is provided with a recess and is designed to receive the conical element and which has an inner surface such that the grooves are at least partially covered by the inner surface in order to form a multiplicity of channels, wherein the channels define outlets in order to let out a respective fluid jet which strikes against at least one further fluid jet in a region spaced apart from the upper surface in order thus to atomize the fluid flow, and wherein the conical element is movable along the axis in order to increase or to reduce the effective cross section of the nozzle arrangement.

"Effective cross section" means the sum of cross-sectional areas of the channels plus the cross-sectional area of a gap between the conical element and the counter element in a sectional plane.

Use is therefore no longer made of a flat geometry of the nozzle arrangement, but rather of a three-dimensional geometry which affords diverse possibilities of designing the channels in a desired manner. For example, it is easy to modify the channel depth, and also finely structured channels can be obtained. The driving pressure will bring the conical element of the nozzle arrangement into the recess of the counter element, and the major portion of the forces introduced is guided into the solid counter element. On the other hand, the removal of the pressure makes it possible for the conical element to move along its axis, and therefore the effective cross section of the nozzle is increased by means of a gap between the conical element and the counter element. For example, impurities can easily be removed by a pulsed change in the driving pressure.

In a preferred embodiment, at least one of the channels has a cross section which differs from a cross section of at least one other of the channels. Liquids of differing viscosity can therefore be used in the same nozzle by, for example, unsuitable channels being selectively partitioned off by any suitable device.

It is furthermore preferred that the cross section of at least one of the channels is reduced from the lower surface toward the upper surface. This means that wider and deeper inlet surfaces are available, and therefore the pressure drop in the channel is much smaller than in the case of the flat nozzle made from silicon from the prior art. The cross section can be reduced gradually or continuously or in one or more steps. A comparable spray behavior at pressures far below 50 bar can therefore be achieved.

In one embodiment, the position of the conical element within the recess of the counter element can be adjustable depending on the viscosity of the fluid. It is therefore possible to atomize fluids of a wider range of viscosity, which require a larger channel in order to achieve the desired kinetic energy for the atomization.

The channel outputs are preferably designed in such a manner that there is more than one impact point for the fluid jets in the region spaced apart from the upper surface of the conical element.

It is furthermore preferred that the conical element can be temporarily removed out of the counter element. This affords the possibility of cleaning the nozzle arrangement in the event of a severe blockage. The pushing down of the conical element will open the channels and a cleaning thrust will remove the blockage. Finally, the conical element is returned into the working position.

In one aspect, a central passage is provided within the conical element, which passage will modify the jet properties of the particle cloud into a mist which is more easily directed forward.

It is preferred for the nozzle arrangement that the conical element and/or the counter element is produced by plastics molding techniques, for example injection molding, being used.

The nozzle arrangement of the invention therefore provides a flexible possibility of design making it possible to meet all of the requirements for fluids with a wide range of viscosity in accordance with the desired application.

DESCRIPTION OF THE DRAWINGS

The invention will be described in further details merely by way of example using a number of exemplary embodiments with reference to the attached drawings, wherein.

DESCRIPTION OF THE PREFERRED EMBODIMENTS

Figure 1:
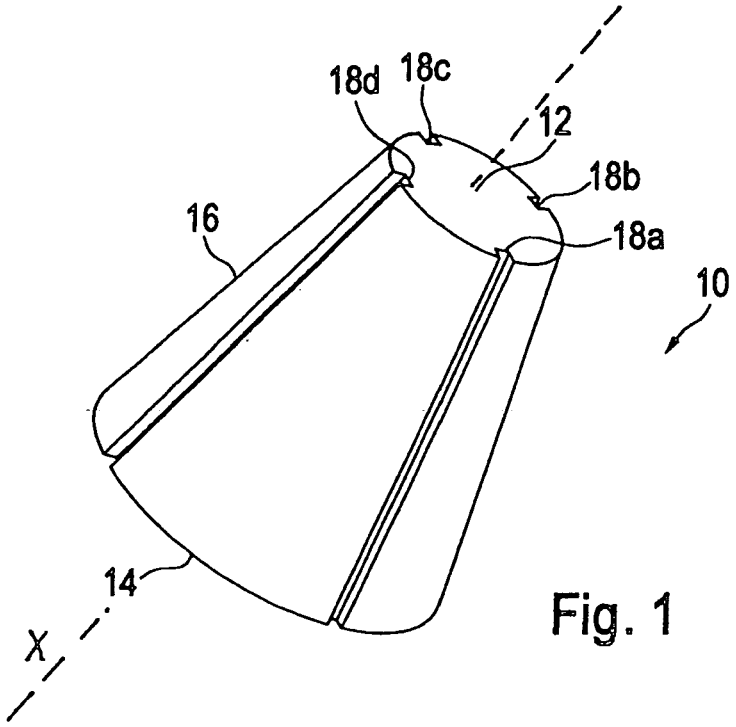
FIG. 1 is a schematic perspective view of a conical element of a preferred embodiment of a nozzle arrangement according to the invention.

FIG. 1 is a schematic perspective view of an example of a conical element 10 which is used in a nozzle arrangement of the invention. The conical element 10 has an upper surface 12, a lower surface 14 and an outer surface 16 which is adjacent to the upper surface 12 and to the lower surface 14. The outer surface 16 has four grooves 18*a*, 18*b*, 18*c*, 18*d* which are spaced apart at an angle of 90° and extend between the lower surface 14 and the upper surface 12. Of course, it is possible to provide two or three grooves or more than four grooves, if this is necessary. An axis X is defined for the conical element 10, for example an axis of rotational symmetry. Other positions and orientations of the axis X are possible.

Figure 2:
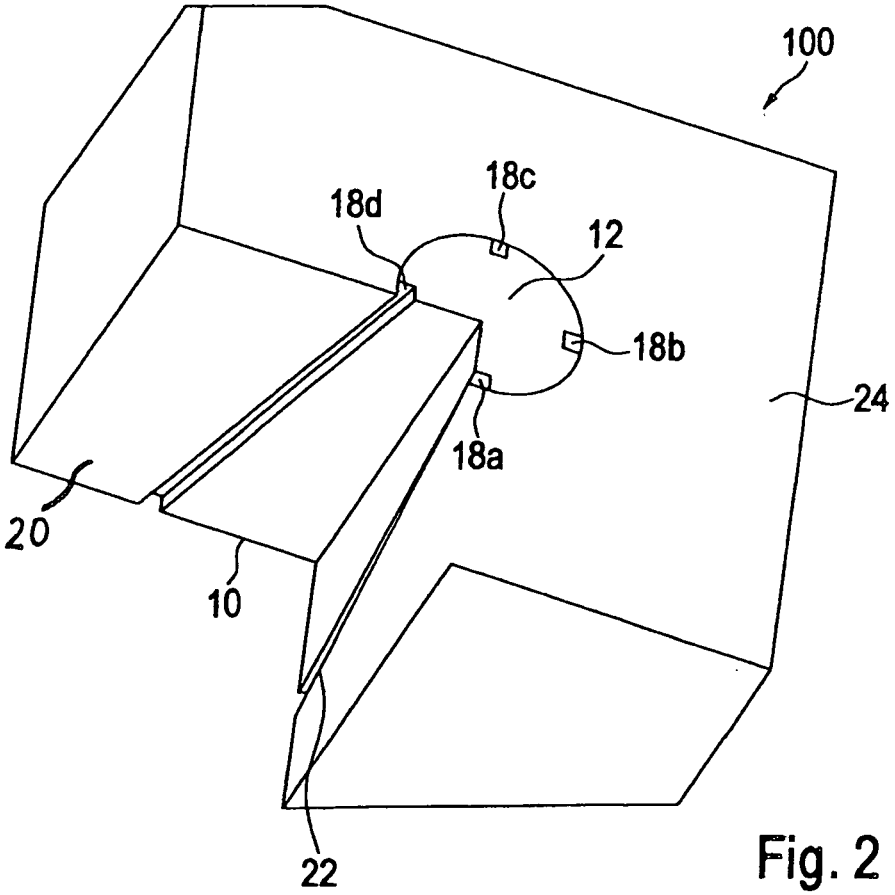
FIG. 2 is a schematic, partially cut away, perspective view of a preferred embodiment of a nozzle arrangement according to the invention.

FIG. 2 shows a perspective view, partially cut away, of an embodiment of a nozzle arrangement 100 according to the invention. The nozzle arrangement 100 has a counter element 20 which is provided with a recess, wherein the recess defines an inner surface 22 which is designed to receive the conical element 10, as shown in FIG. 1. The grooves 18*a*, 18*b*, 18*c*, 18*c* of the conical element 10 are covered by the inner surface 22, and therefore a multiplicity of channels is formed. In the embodiment of FIG. 2, the grooves 18*a*, 18*b*, 18*c*, 18*d* are completely covered by the inner surface 22, and the upper surface 12 is aligned with the upper surface 24 of the counter element 20. The channels which are formed by the covered grooves 18*a*, 18*b*, 18*c*, 18*d* define outputs in the plane of the upper surfaces 12, 24 in order to let out a respective fluid jet. The conical element 10 is movable along the axis X (FIG. 1) within the counter element 20 in order to change the effective cross section of the nozzle arrangement 100 if this is necessary.

Figure 3A:
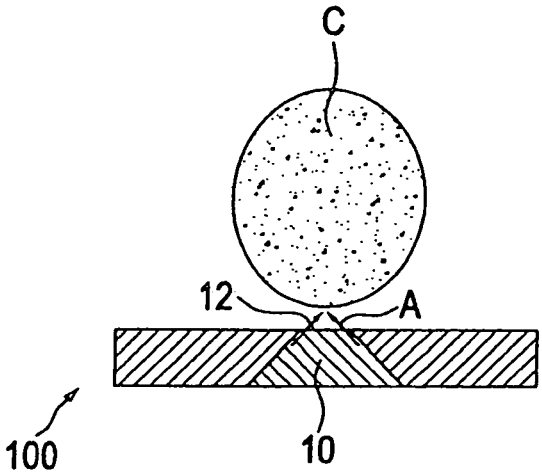
FIG. 3A is a schematic cross-sectional view of a jet characteristic which can be achieved with the nozzle arrangement of the invention.
Figure 3B:
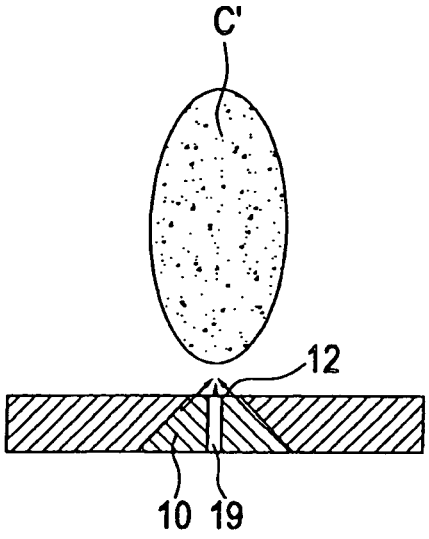
FIG. 3B is a schematic cross-sectional view, similar to that of FIG. 3A, of a jet characteristic of a modified embodiment of a nozzle arrangement of the invention.

FIG. 3A shows a cross-sectional view of the nozzle arrangement 100 of FIG. 2. As is explained with respect to FIG. 2, the fluid jets A which emerge from the nozzle arrangement 100 strike against one another in a region which is spaced apart from the upper surface 12 of the conical element 10 such that the fluid flow is atomized and forms an atomized cloud C with an approximately circular or slightly oval shape. If other cloud shapes are desired, it is possible to modify the design of FIG. 2, for example as is shown in FIG. 3B. The conical element 10 is additionally provided with a passage 19 which extends centrally within the conical element 10 from the lower surface 14 to the upper surface 12. An additional fluid flow through the passage 19 will convert the cloud C into the cloud C', and therefore into a spray mist which is more directed forward.

Figure 4A:
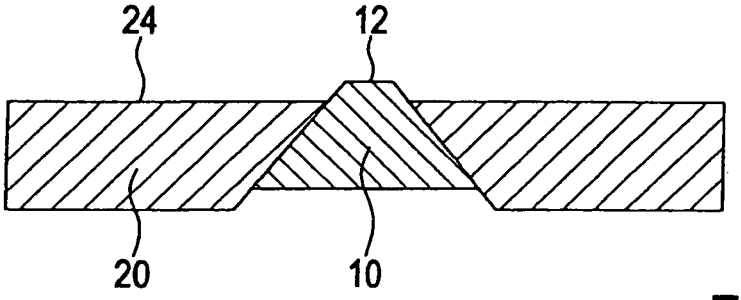
FIGS. 4A and 4B are schematic cross-sectional views of exemplary nozzle arrangements in order to explain tolerance considerations.
Figure 4B:
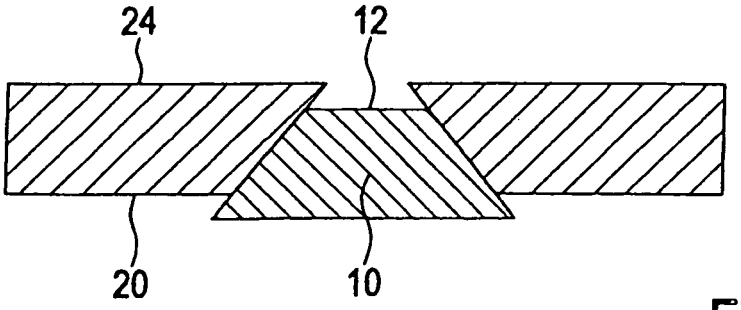

The nozzle arrangement according to the invention can be completely produced using plastics molding techniques. Tolerances which arise from the assembly process have to be accepted. As is shown in a schematic cross-sectional view in FIG. 4A, the dimensions of the conical element 10 are such that the upper surfaces 12, 24 of the conical element 10 and of the counter element 20 are not aligned in each case, but rather the upper surface 12 is located above the upper surface 24. However, the fluid jet is transported through the channel outputs virtually precisely as before. On the other hand, however, if the dimensions of the conical element 10 are such that said element is not completely accommodated in the counter element 20 when the latter is used as shown in FIG. 4B, the upper surface 12 of the conical element 10 will be located below the upper surface 24 of the counter element 20, which results in a fluid jet which possibly touches the inner surface 22 of the counter element 20 and therefore is not guided out of the nozzle arrangement in a suitable manner.

Figure 5A:
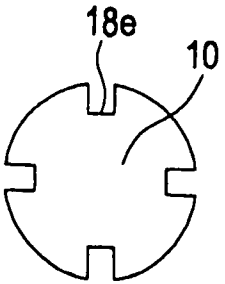
FIG. 5A-5F are cross-sectional views of the channel designs which are used in a nozzle arrangement according to the invention.
Figure 5B:
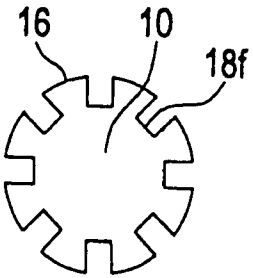
Figure 5C:
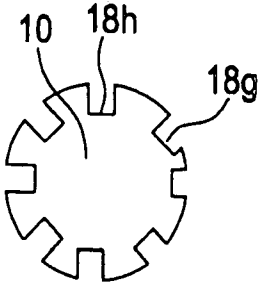
Figure 5D:
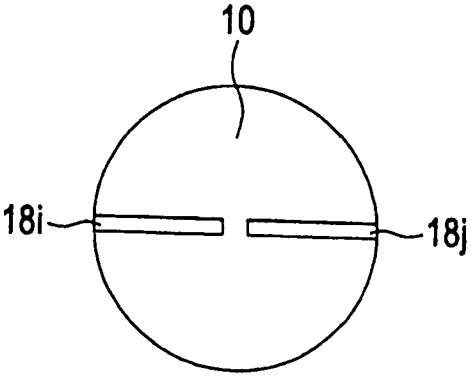
Figure 5E:
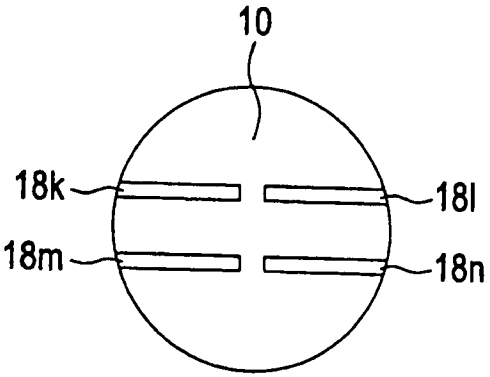
Figure 5F:
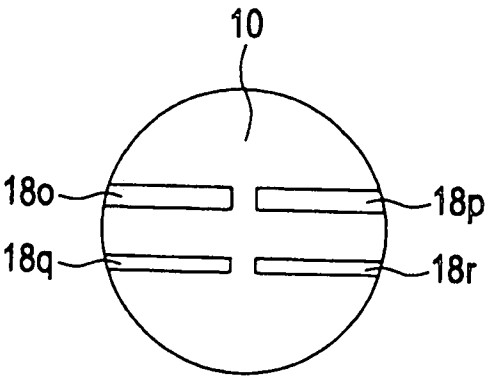

Although the invention requires at least two channels to converge in order to atomize the fluid flow, more than two channels or grooves can be provided in the conical element 10. A number of examples are shown in FIG. 5A-5F. FIG. 5A shows a sectional view of the conical element 10, in which one of the grooves 18*e* has a cross section which differs from the cross section of the other grooves. FIG. 5B shows a conical element 10 with eight grooves 18*f* of identical shape, which grooves, however, are spaced apart in an irregularly angled manner on the outer surface 16 of the conical element 10. FIG. 5C shows a conical element 10 with grooves 18*g* of a depth which is less than the depth of further grooves 18*h*. FIG. 5D shows grooves 18*i*, 18*j* which lie diametrically opposite each other in the conical element 10 and extend virtually as far as the center of the conical element 10. Double or triplicate structures, as shown in FIGS. 5E and 5F, are also conceivable. Two similar jets or clouds of atomized fluid are produced by two pairs of parallel grooves 18*k*, 18*l* and 18*m*, 18*n* which have approximately the same dimensions. Different jets can be produced by one pair of grooves 18*o*, 18*b* being modified in such a manner that they have a greater width than the other pair of grooves 18*q*, 18*r*. Further modifications can be taken into consideration depending on requirements.

Figure 6:
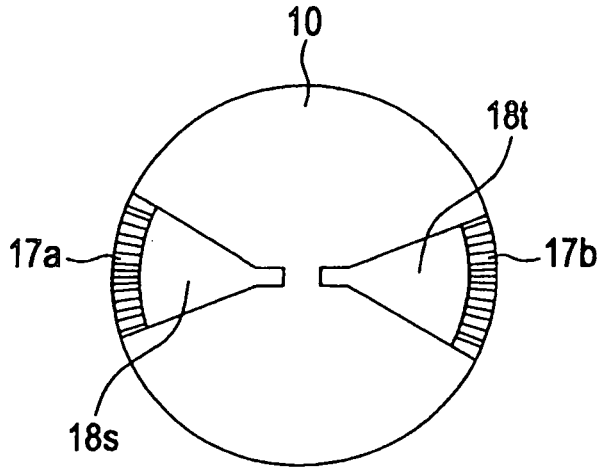
FIG. 6 is a cross-sectional view of a conical element with filter structures.

There are applications in which it may be necessary for the fluid to be filtered. An exemplary embodiment of a correspondingly modified conical element 10 is shown in the cross-sectional view of FIG. 6. Two mutually opposite grooves 18*s*, 18*t* are in each case provided with a filter element 17*a*, 17*b* on the outer circumference of the conical element 10.

A further route to realizing a different channel characteristic is to block some of the channels at a predetermined position. By rotation of the conical element 10 or counter element 20, a previously blocked channel is opened and an open one is blocked. A nozzle which is suitable for fluids of two or more differing viscosities can therefore be produced.

Furthermore, the cross section of at least one of the channels of the nozzle arrangement, preferably all of the channels of the nozzle arrangement, decreases from the lower surface of the conical element 10 to the upper surface in order to reduce the pressure drop. The decrease can take place continuously or in steps.

Figure 7:
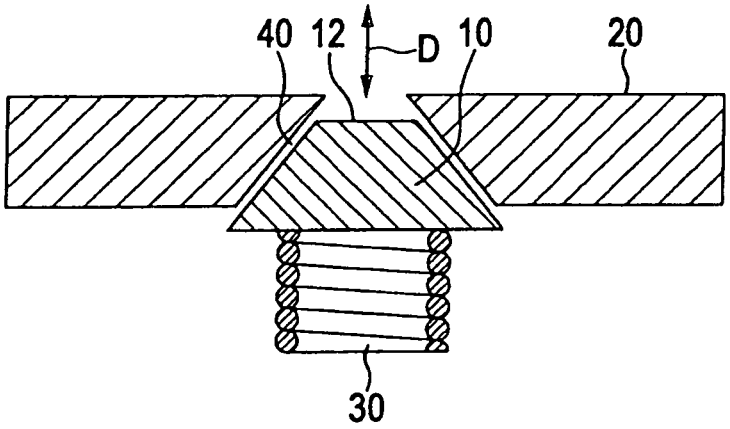
FIG. 7 shows a cross-sectional view of an embodiment of the nozzle arrangement according to the invention, wherein the conical element is movable with respect to the counter element.

FIG. 7 shows an embodiment of a nozzle arrangement according to the invention, in which the conical element 10 is movable with respect to the counter element 20 in directions which are shown by the double arrow D. The conical element 10 is held by a spiral spring 30. If the conical element 10 is pushed downward by pressure being applied to the upper surface 12, the grooves which are present in the conical element 10 are opened, and therefore it is possible for blocking particles which are stuck in the grooves to be able to escape because of the higher pressure of the fluid which flows through the gap 40, wherein the gap is temporarily present between the conical element 10 and the counter element 20. The returning force of the spiral spring 30 will immediately close the gap 40 when the force is removed from the upper surface 12 of the conical element 10. A further possibility of providing a gap 40 between the conical element 10 and the counter element 20 can be provided by a threaded screw instead of the spiral spring 30 on the conical element 10, wherein the screw can be rotated within a threaded nut.

Figure 8A:
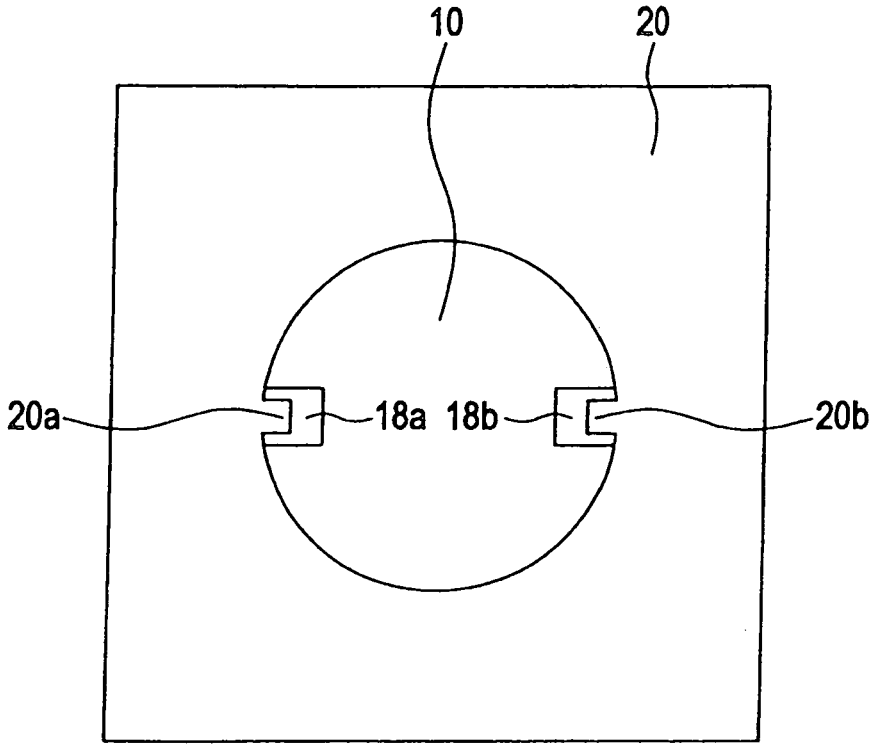
FIGS. 8A and 8B show sectional views of an embodiment of a nozzle arrangement according to the invention, in which the counter element has been modified.
Figure 8B:
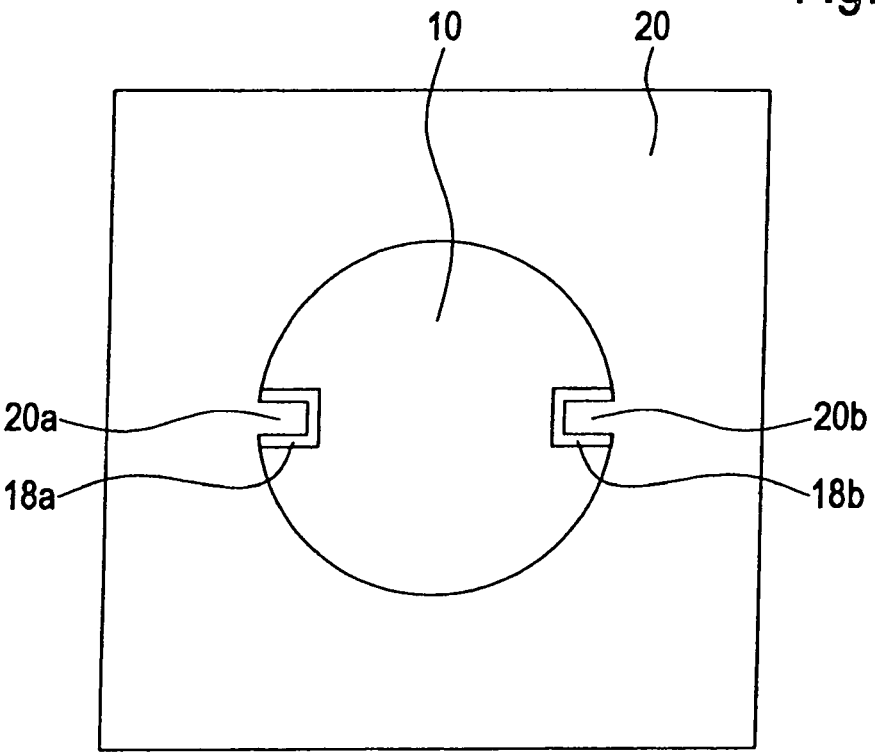

FIG. 8A shows, in a cross-sectional view, an embodiment of a nozzle arrangement according to the invention, in which the counter element 20 is modified in order to vary the channel depth and therefore to vary the cross section of the channel between the upper and the lower surface of the conical element 10. FIG. 8A shows the situation in the vicinity of the lower surface of the conical element 10. A projection 20*a*, 20*b* in each of the grooves 18*a*, 18*b* reduces the cross section of a channel to a desired area. FIG. 8B shows the situation in the vicinity of the upper surface of the conical element 10. The cross section of the projections 20*a*, 20*b* is increased, and therefore the cross-sectional area of the channels defined by the grooves 18*a*, 18*b* is considerably reduced. This configuration therefore reduces the pressure drop within the nozzle arrangement.

The features disclosed above in the description, in the claims and/or in the accompanying drawings may be essential individually and in any combination for realizing the invention in the various forms thereof.

The invention claimed is:

1. A nozzle arrangement for an inhaler for administering a medicament by inhalation for atomizing a fluid flow, the nozzle arrangement being designed for atomizing a fluid flow, which is supplied under pressure, into fine particles, comprising:

a conical element with an upper surface, a lower surface and an outer surface which is adjacent to the upper and the lower surface, wherein the outer surface has a multiplicity of grooves extending between the lower surface and the upper surface; and a counter element which is provided with a recess and is designed to receive the conical element, the recess of the counter element having an inner surface such that the multiplicity of grooves are at least partially covered by the inner surface in order to form a multiplicity of channels;

wherein the multiplicity of channels define outputs in the upper surface in order to let out a respective fluid jet which strikes against at least one other fluid jet in a region spaced apart from the upper surface of the conical element in order thus to atomize the fluid flow in the form of a cloud, wherein the conical element is moveable along an axis defined for the conical element by tensioning or releasing the tension of a spring mechanism, in order to increase or to reduce an effective cross section of the nozzle arrangement, wherein the multiplicity of grooves are radially aligned along the conical element and form at least one pair of diametrically opposed channels oriented to converge in order to atomize the fluid flow.

2. The nozzle arrangement for an inhaler as claimed in claim 1, wherein the position of the conical element within the recess of the counter element is adjustable depending on the viscosity of the fluid.

3. The nozzle arrangement for an inhaler as claimed in claim 2, wherein the axis is an axis of rotational symmetry, and in that the position of the conical element is adjusted by rotation of the conical element or of the counter element.

4. The nozzle arrangement for an inhaler as claimed in claim 1, wherein the channel outputs are designed in such a manner that there is more than one impact point of the fluid jets in the region spaced apart from the upper surface of the conical element.

5. The nozzle arrangement for an inhaler as claimed in claim 1, wherein the conical element is temporarily removable from the counter element.

6. The nozzle arrangement for an inhaler as claimed in claim 1, wherein a central passage is provided in the conical element.

7. The nozzle arrangement for an inhaler as claimed in claim 1, wherein the conical and/or the counter element is produced by plastics molding techniques being used.

8. The nozzle arrangement for an inhaler of claim 1, wherein at least one of the multiplicity of channels has a cross section which differs from a cross section of at least a further one of the multiplicity of channels.

9. The nozzle arrangement for an inhaler as claimed in claim 8, wherein the cross section of at least one of the multiplicity of channels decreases from the lower surface towards the upper surface.

10. The nozzle arrangement for an inhaler of claim 1, wherein the conical element is moved by the spring mechanism.

11. The nozzle arrangement for an inhaler of claim 10, wherein the spring mechanism is a spring.

12. The nozzle arrangement for an inhaler of claim 10, wherein the conical element is moved by pressure being applied against the spring mechanism.

13. The nozzle arrangement for an inhaler as claimed in claim 1, wherein the cloud has a circular or oval shape.

14. A nozzle arrangement for an inhaler for administering a medicament by inhalation for atomizing a fluid flow, the nozzle arrangement being designed for atomizing a fluid flow, which is supplied under pressure, into fine particles, comprising:

a conical element with an upper surface, a lower surface and an outer surface which is adjacent to the upper and the lower surface, wherein the outer surface has a multiplicity of grooves extending between the lower surface and the upper surface; and a counter element which is provided with a recess and is designed to receive the conical element, the recess of the counter element having an inner surface such that the multiplicity of grooves are at least partially covered by the inner surface in order to form a multiplicity of channels;

wherein the multiplicity of channels define outputs in the upper surface in order to let out a respective fluid jet which strikes against at least one other fluid jet in a region spaced apart from the upper surface of the conical element in order thus to atomize the fluid flow, wherein an axis is defined for the conical element, and the conical element is configured so that a driving pressure can push the conical element into the recess of the counter element, and upon removal of the driving pressure the conical element moves along its axis out of the recess of the counter element so that an effective cross section of the nozzle is increased by means of a gap between the conical element and the counter element, wherein the multiplicity of grooves are radially aligned along the conical element and form at least one pair of diametrically opposed channels oriented to converge in order to atomize the fluid flow.

15. A nozzle arrangement for an inhaler for administering a medicament by inhalation for atomizing a fluid flow, the nozzle arrangement being designed for atomizing a fluid flow, which is supplied under pressure, into fine particles, comprising:

a conical element with an upper surface, a lower surface and an outer surface which is adjacent to the upper and the lower surface, wherein the outer surface has a multiplicity of grooves extending between the lower surface and the upper surface; and a counter element which is provided with a recess and is designed to receive the conical element, the recess of the counter element having an inner surface such that the multiplicity of grooves are at least partially covered by the inner surface in order to form a multiplicity of channels;

wherein the multiplicity of channels define outputs in the upper surface in order to let out a respective fluid jet which strikes against at least one other fluid jet in a region spaced apart from the upper surface of the conical element in order thus to atomize the fluid flow, wherein the conical element is moved along an axis defined for the conical element by tensioning or releasing the tension of a spring mechanism, in order to increase or to reduce an effective cross section of the nozzle arrangement, wherein the multiplicity of grooves are radially aligned along the conical element and form at least one pair of diametrically opposed channels oriented to converge in order to atomize the fluid flow.

* * * * *